United States Patent [19]

Smith et al.

[11] Patent Number: 4,752,977

[45] Date of Patent: Jun. 28, 1988

[54] HANDLE FOR RELEASING SIDE RAIL OF A CRIB

[75] Inventors: Arthur D. Smith, Greenville; Charles A. Clune, Minster, both of Ohio

[73] Assignee: Midmark Corporation, Versailles, Ohio

[21] Appl. No.: 855,996

[22] Filed: Apr. 25, 1986

[51] Int. Cl.[4] ..... A47D 7/02

[52] U.S. Cl. ..... 5/93 R; 5/100; 292/336.3

[58] Field of Search ..... 5/93 R, 100, 425, 424, 5/428, 174; 292/336.3

[56] References Cited

U.S. PATENT DOCUMENTS

| | | | |
|---|---|---|---|
| 1,179,685 | 4/1916 | Vallone | 5/100 |
| 1,524,236 | 1/1925 | Goodman et al. | 5/100 |
| 1,961,593 | 6/1934 | Neunherz et al. | 5/100 |
| 2,070,090 | 2/1937 | Neunherz et al. | 5/100 |
| 2,318,412 | 5/1943 | Neunherz | 5/100 X |
| 2,817,854 | 12/1957 | Pratt | 5/428 |
| 3,590,403 | 7/1971 | Mixon | 5/100 |
| 3,846,854 | 11/1974 | Bryant | 5/425 X |
| 3,857,122 | 12/1974 | Bryant | 5/100 |
| 3,896,513 | 7/1975 | Boucher et al. | 5/100 X |
| 3,905,625 | 9/1975 | Bryant | 5/100 X |
| 3,919,728 | 11/1975 | Bryant | 5/100 |
| 3,934,282 | 1/1976 | Bryant | 5/428 X |
| 3,955,837 | 5/1976 | Christensen | 5/425 X |

FOREIGN PATENT DOCUMENTS

| | | | |
|---|---|---|---|
| 948010 | 8/1956 | Fed. Rep. of Germany | 5/100 |
| 603176 | 3/1960 | Italy | 5/100 |
| 21268 | of 1899 | United Kingdom | 5/100 |
| 21666 | of 1900 | United Kingdom | 5/100 |
| 22757 | of 1908 | United Kingdom | 5/100 |
| 119598 | 10/1918 | United Kingdom | 5/100 |
| 1424190 | 2/1976 | United Kingdom | 292/171 |

*Primary Examiner*—Alexander Grosz
*Assistant Examiner*—Carl M. DeFranco, Jr.
*Attorney, Agent, or Firm*—Biebel, French & Nauman

[57] ABSTRACT

A crib having a frame and a bed supported by the frame includes at least one side rail assembly for enclosing one side of the bed surface. The side rail is attached to the frame for raising and lowering movement of the side rail. A latch assembly releasably secures the side rail in a raised position. A handle assembly includes a first rod connected to the side rail. A second rod is slidably connected to and located above the first rod for movement relative thereto. An actuator is connected between the second rod and the latch so that movement of the second rod toward the first releases the latch. The rods may be pivotally moved away from the side rail. A projection attached to the side rail is positioned between the rods to prevent movement of the rods for releasing the latch unless the rods are first pivoted away from the side rail.

8 Claims, 5 Drawing Sheets

HANDLE FOR RELEASING SIDE RAIL OF A CRIB

BACKGROUND OF THE INVENTION

The present invention relates generally to cribs having raisable and lowerable side railings for keeping a child within the crib. More particularly, the invention relates to the handle used in releasing a latch assembly that retains the side rail in its upper position.

It is well known to provide cribs for infants or small children that include side railings to prevent the crib occupant from inadvertently falling to the floor, or from deliberately climbing from the crib. To facilitate placing the child into the crib, or taking the child out of the crib, the side railings are typically mounted to the crib structure to enable them to be raised and lowered. One or more latching mechanisms are provided to retain the side rail within its raised position, and the latch mechanisms must be released when it is desired to lower the side rail.

It is important, however, that the release mechanism for the side rail be designed so as to resist operation by the occupant of the crib. The side rail assembly is typically relatively heavy, particularly for a child. Consequently, release of the side rail by the child could prove to be hazardous. Moreover, it is normally undesirable for a small child to be able to get out of the crib whenever he or she may want.

This problem has been recognized in crib latch mechanisms known in the prior art. For example, in U.S. Pat. No. 3,934,282 (Bryant), a safety trip lock is provided that includes a wire positioned along the bottom of the side rail assembly for engaging each corner post of the crib. To lower the side rail, not only must one release the normal latch assembly, but also raise the side rail slightly to permit the trip wire to disengage the posts. The side rail can then be lowered.

In another example, U.S. Pat. No. 4,530,528 (Shamie), a latching mechanism is shown which requires two separate actions to release the latch. Two identical latch mechanisms are provided for each side rail, with one mechanism provided for cooperation with each corner post. Each mechanism includes a handle connected at the end of the side rail, with a catch pin extending from the handle into a member carried on the corner post. A head on the pin engages with the opening in the member. Thus, to release the side rail, it is necessary to rotate the handle to cause the pin to align properly with the opening. The handle is then pulled outwardly, to retract the pin from the opening, whereupon the side rail may be lowered, provided the latch assembly at the opposite end of the side rail has also been released.

While resistance to unwanted opening is important, it should not be so difficult to operate the side rail latch mechanism that it becomes a disadvantage to the operator. For example, in both of the latching mechanisms described above, two hands are required to lower the side rail. In Bryant, the rail must be unlatched and held in a raised position with one hand, while the trip wire is manipulated with the second. In the Shamie device, one mechanism must be released, and then while the side rail is held to prevent the released side from lowering, the remaining latch is operated.

Particularly in a hospital setting, but also in the home, it frequently happens that the crib is approached by an attendant holding the child, a medicine, a medical apparatus or some other item needed for the care of the child. In such a case, when the crib is provided with a latching mechanism such as those described above, it is necessary for the attendant to first find a secure location to place the child or item, and only then can the attendant lower the side rail of the crib.

What is needed therefore, is a crib having a latch mechanism for releasing the crib side rail that is resistant to operation by the child occupying the crib. However, at the same time, the latching mechanism should be easily operable by an attendant, and in particular should be capable of operation by the attendant with a single hand.

SUMMARY OF THE INVENTION

The present invention provides a crib having a frame and a bed supported by the frame. At least one side rail assembly is provided for enclosing one side of the bed surface. A means is included for attaching the side rail to the frame for raising and lowering movement of the side rail. A latch means releasably secures the side rail in a raised position.

A handle assembly includes a first member connected to the side rail. A second member is connected to the first member for movement relative thereto. Blocking means prevents the relative movement between the first and second members, but means is provided for selectively disabling the blocking means. An actuator connects the second member and the latch means. Thus, upon disabling of the blocking means and upon relative movement between the first and second members, the actuator releases the latch means for lowering of the side rail.

The first and second members may be first and second bars which are disposed in vertical and in parallel alignment. The first bar is connected to the side rail assembly, and the second bar is connected to the first bar for movement toward and away from the first bar while maintaining the parallel relationship therebetween. The blocking means may be a projection connected to the side rail that extends between the first and second members to prevent movement of the second bar toward the first bar.

The first bar may be disposed beneath the second bar, with a pair of posts extending upwardly therefrom. The second bar moves along the posts, and the posts are connected at the upper ends for pivotal movement away from the side rail assembly. Thus, the means for selectively disabling the blocking means includes the posts, in that pivotal movement of the first and second bars outwardly from the side rail causes the blocking means to be moved away from its disposition between the first and second bars.

The actuator may include a cable connected to the second bar, whereby movement of the second bar toward the first bar moves the cable to actuate the latch means.

Accordingly, it is an object of the present invention to provide a crib having a latch means that includes a handle assembly for actuating the latch means to release the side rail of the crib; to provide such a crib in which the handle operates in a manner that resists operation by a child occupying the crib; to provide such a crib in which the handle is specifically adapted to require a two-motion operation to release the latch mechanism; to provide such a crib having a handle for actuating the latch mechanism that, although resistant to operation by a child, is easily operated by an adult attending the child; and to provide such a crib in which the handle and latch mechanism is of relatively simple design to facilitate inexpensive manufacture and assembly.

Other objects and advantages will be apparent from the following description, the accompanying drawings, and the appended claims.

DETAILED DESCRIPTION OF THE PREFERRED EMBODIMENT

Figure 1:
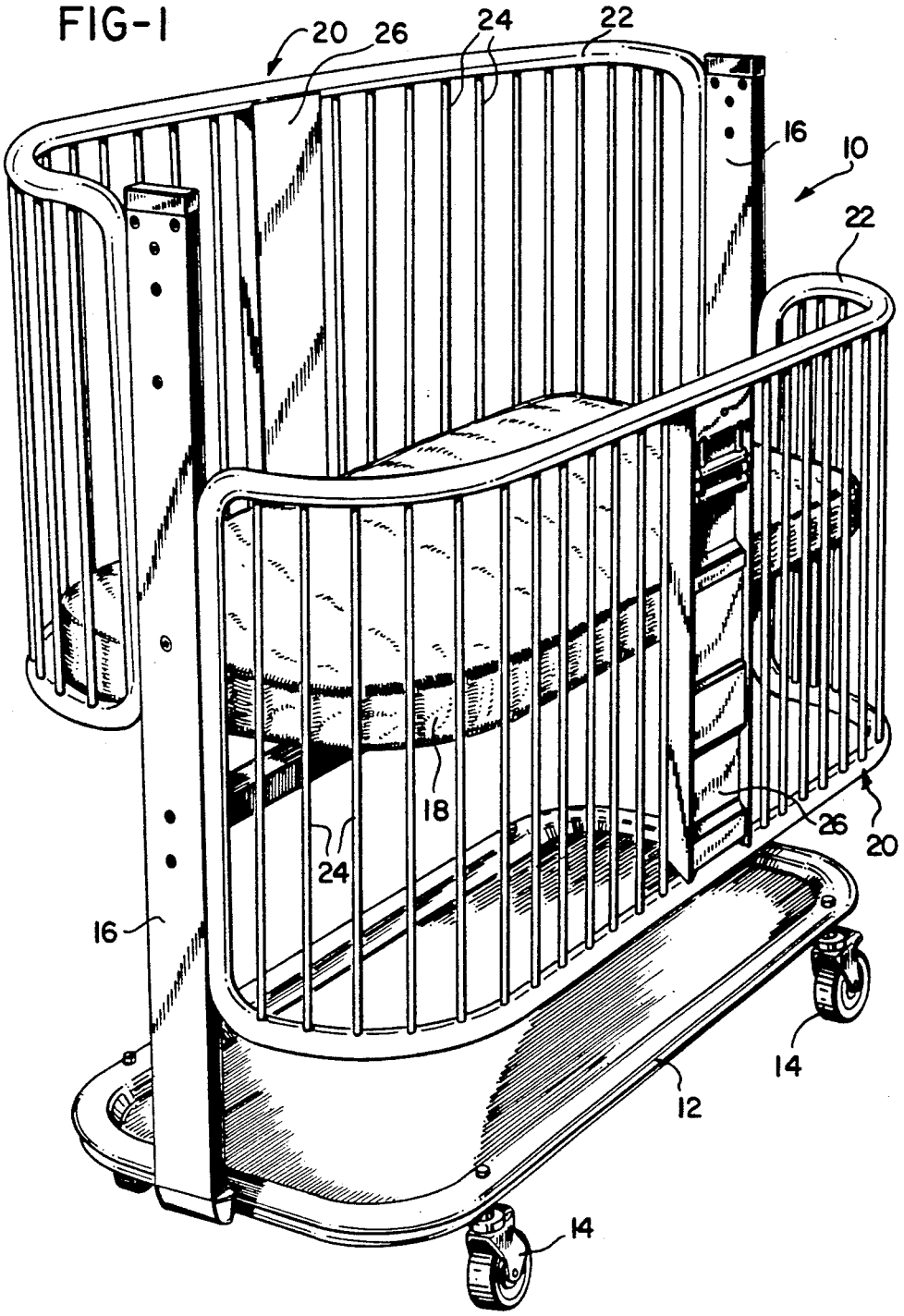
FIG. 1 is a perspective view of a crib including a handle and latch mechanism for releasing the side rails in accordance with the present invention.

A preferred crib constructed in accordance with the present invention is shown generally in FIG. 1. While the preferred crib is particularly intended for use in a hospital environment, it should be recognized that the crib could also be use in the home or other appropriate settings. Further, it should be recognized that the present invention is capable of use with cribs differing in appearance from that shown in FIG. 1, for example, with a crib more typical of those specifically designed for home use.

As shown in FIG. 1, the crib 10 includes a base 12 that is supported by a plurality of wheels 14 so that the crib may be easily moved about as necessary. A pair of end posts 16 extend upwardly from base 12. A bed portion 18 including a mattress supported on an appropriate frame (not shown) is connected between posts 16. Base 12, posts 16 and the frame supporting bed portion 18 together comprise the crib frame. A pair of side rail assemblies 20 are mounted to posts 16. In FIG. 1, the forward assembly 20 is shown in the lowered position, while the rearward assembly 20 is shown in the raised position.

The assemblies 20 are preferably primarily formed from steel, and each includes outer tubing 22 defining the outer periphery of the assembly 20. Tubing 22 is preferably formed into two separate pieces that are subsequently joined together. A plurality of upright bars 24 are connected, for example by welding, between the tubing 22. In addition, a central panel 26 is mounted between tubing 22 at the middle of the assembly 20.

Figure 2:
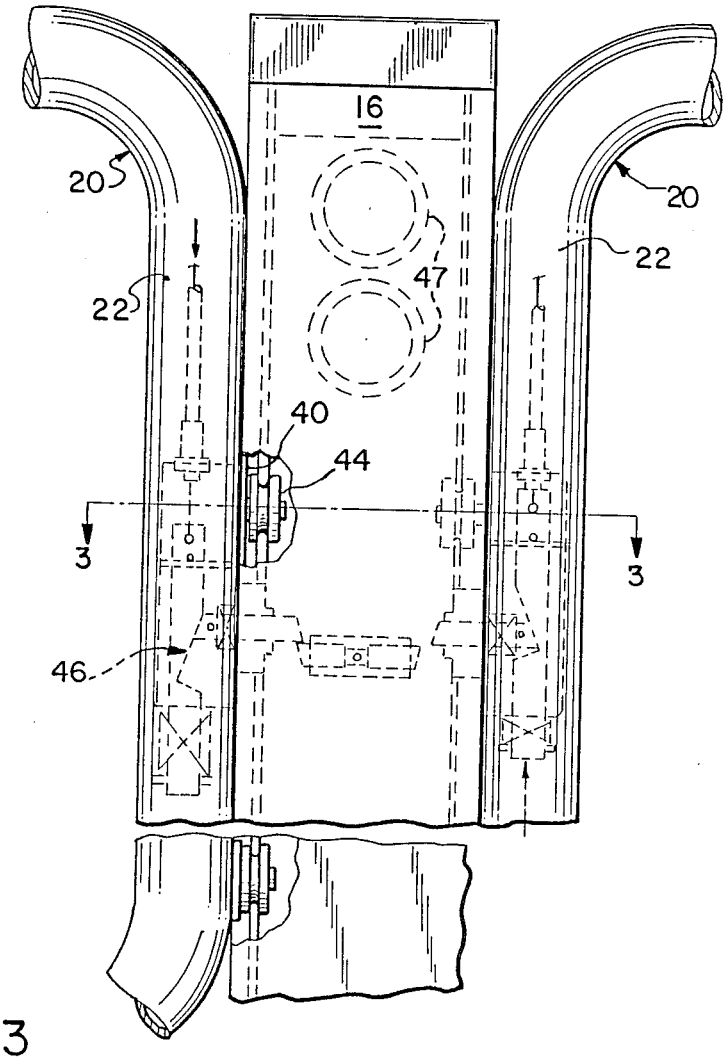
FIG. 2 is a partial end view of the crib side rails and frame post, showing the latch mechanisms.
Figure 3:
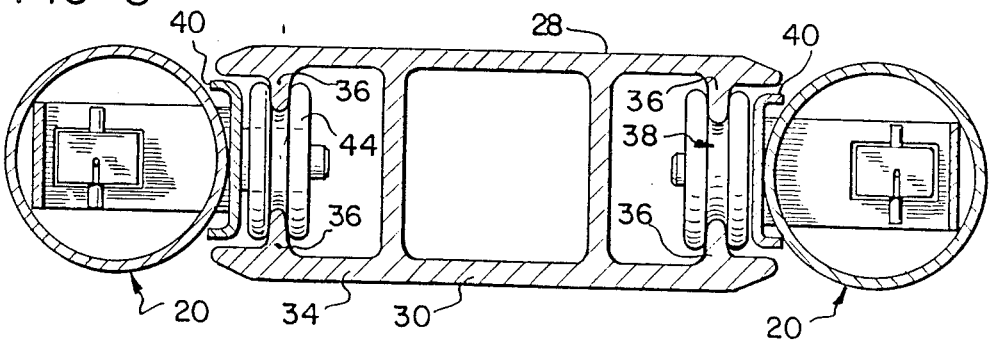
FIG. 3 is a sectional view taken generally along line 3—3 of FIG. 2.

The means by which side rail assemblies 20 are attached to the crib frame may be seen generally by reference to FIGS. 2 and 3. Referring first to FIG. 3, each post 16 is preferably a one-piece aluminum extrusion, and defines a pair of outer walls 34. Extending inwardly from near each edge of each outer wall 34 is a pair of flanges 36. Opposed flanges 36 on walls 34 do not meet, but rather form a gap 38 between the outer edges of each pair of opposed flanges 36.

Referring back to FIG. 2, upper and lower mounting plates 40 and 42 respectively, are connected to tubing 22 of side rail assembly 20 adjacent post 16. A wheel 44 having a central groove is rotatably secured to each mounting plate 40 and 42. As is seen in FIG. 3, the groove in each wheel 44 fits within the gap 38 created between the flanges 36 of post 16, so that flanges 36 and wheels 44 cooperate to guide the side rail assemblies 20 upwardly and downwardly along the posts 16.

Figure 4:
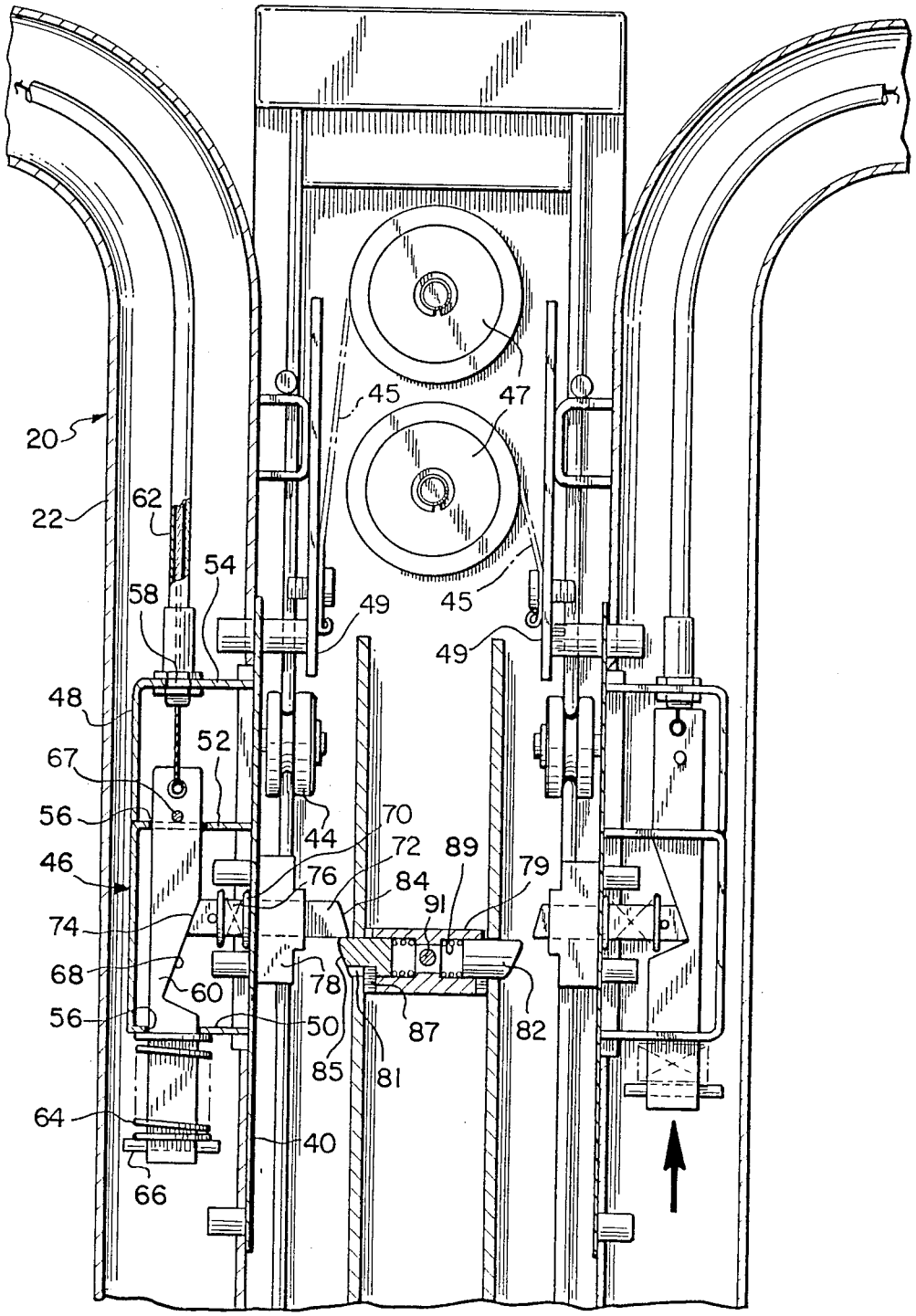
FIG. 4 is an enlarged and sectional portion of the view of FIG. 2.

In order to minimize the effective weight of the side rail assemblies 20 as they are raised or lowered, counterbalancing springs are provided as shown in FIG. 2 and, in greater detail, in FIG. 4. Each spring 45 is coiled onto a spool 47 which is secured for rotation to the interior of post 16. The leading end of each spring 45 is fastened by a bolt or a rivet to a spring retaining plate 49, which is in turn connected to one of the mounting plates 40. Thus, each side rail assembly 20 has two springs 45 attached, one at each end. When the assembly is released for movement downwardly along posts 16, or is subsequently raised, the springs help to urge the assembly upward, although they do not produce enough lifting force to actually raise the assembly. As a result, most of the actual weight of the assemblies 20 is not felt by an operator.

Each side rail assembly 20 is retained in its raised position by a latch mechanism 46 connected to the upright portion of tubing 22 at each end of side rail assembly 20. Each latch mechanism 46 acts to engage post 16 to hold assembly 22 in place.

Latch mechanism 46 may be seen in detail by reference to FIG. 4. Mounting plate 40 is connected to side rail assembly 20 and, as noted, supports grooved wheel 44. In addition, a retaining structure 48 is mounted to the rear side of plate 40, so as to be disposed within tubing 22 of side rail assembly 20. Retaining structure 48 includes parallel plates 50, 52 and 54, with plates 50 and 52 including slots 56 formed therein, and plate 54 including hole 58. A trip bar 60 passes through slots 56, so that bar 60 is vertically movable behind mounting plate 40. Bar 60 is attached at its upper end to a cable 62 which holds bar 60 in position. In addition, a spring 64 is disposed around the lower portion of bar 60, and acts against plate 50 and a pin 66 extending through bar 60 to urge bar 60 downwardly. A second pin 67 is provided througn bar 60 near its upper end, and is drawn into contact with plate 54 under the action of spring 64 to provide a stop for bar 60.

A beveled notch 68 is formed in the edge of bar 60 adajcent to mounting plate 40. An opening 70 extends through mounting plate 40, with bar 60 normally urged by spring 64 so that notch 68 is positioned generally below opening 70. This normal position for bar 60 is shown in the mechanism 46 shown at the left in FIG. 4.

Latch bar 72 is disposed through opening 70 and includes a beveled inner surface 74 having an angle matching that of beveled notch 68 on trip bar 60. A guide member 78 is connected to the outer surface of plate 40 over opening 70 and has a guide channel extending therethrough for containing latch bar 72. A spring 76 is disposed between guide member 78 and a pin 80 extending through bar 72 to urge latch bar 72 against trip bar 60. However, when in the normal position shown in FIG. 4, pawl latch bar 72 contacts trip bar 60 at the uppermost portion of notch 68. When so positioned, latch bar 72 extends outwardly from member 76 so as to rest in contact with a pawl 82 secured to the interior of post 16. Thus, latch mechanism 46, and in particular latch bar 72, secures the side rail assembly 20 firmly into its raised position.

Pawl 82 is contained within a sleeve 79 and further includes a groove 81 extending into pawl 82 from its lower side. A set screw 87 extends into groove 81 to prevent pawl 82 from rotating or coming out of sleeve 79. A spring 89 is disposed between pawl 82 and a central block 91 for urging panel 82 outwardly. Central block 91 also provides a connecting location for mounting sleeve 79 to the interior of post 16.

To disengage the latch mechanism from post 16, cable 62 is raised as shown by the right hand mechanism 46 in FIG. 4. This applies a pulling force to raise trip bar 60 to position the deepest portion of notch 68 behind opening 70. Since latch bar 72 is urged by spring 76 toward notch 68, end surface 74 of bar 72 follows the inclined surface of trip bar 68. This withdraws latch bar 72 from pawl 82 in post 16, thereby permitting side rail assembly 20 to be lowered.

It will be recalled that one latch mechanism 46 is provided at each end of each side rail assembly 20. As will be explained in detail below, cables 62 for each of these latch mechanisms 46 are moved at the same time, so that both latches are disengaged from post 16 simultaneously.

It will further be noted that the outer surface 84 of latch bar 72 is formed with a bevel, and that the outer surface 85 of pawl 82 is formed with an opposite, corresponding bevel. When side rail assembly 20 is raised, beveled surfaces 84 and 85 engage, and pawl 82 is forced inwardly to compress spring 89 and to clear latch bar 72. After bar 72 has passed pawl 82, spring 89 causes pawl 82 to return to its original position.

Figure 6:
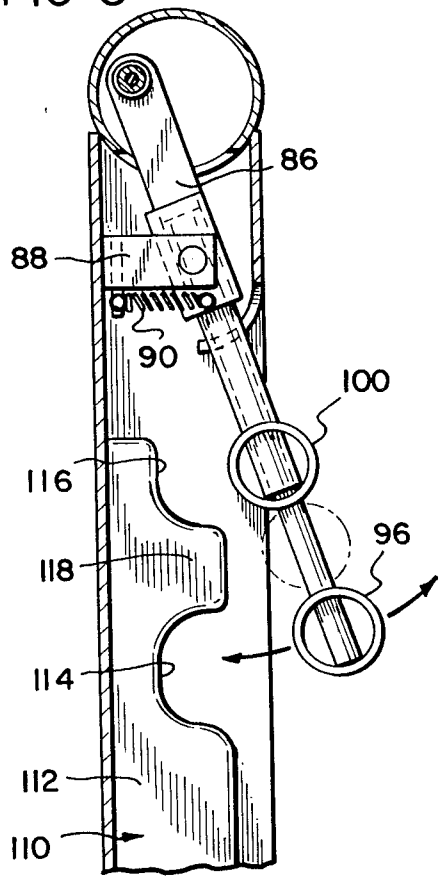
FIG. 6 is a sectional end view taken generally along line 6—6 of FIG. 5.
Figure 5:
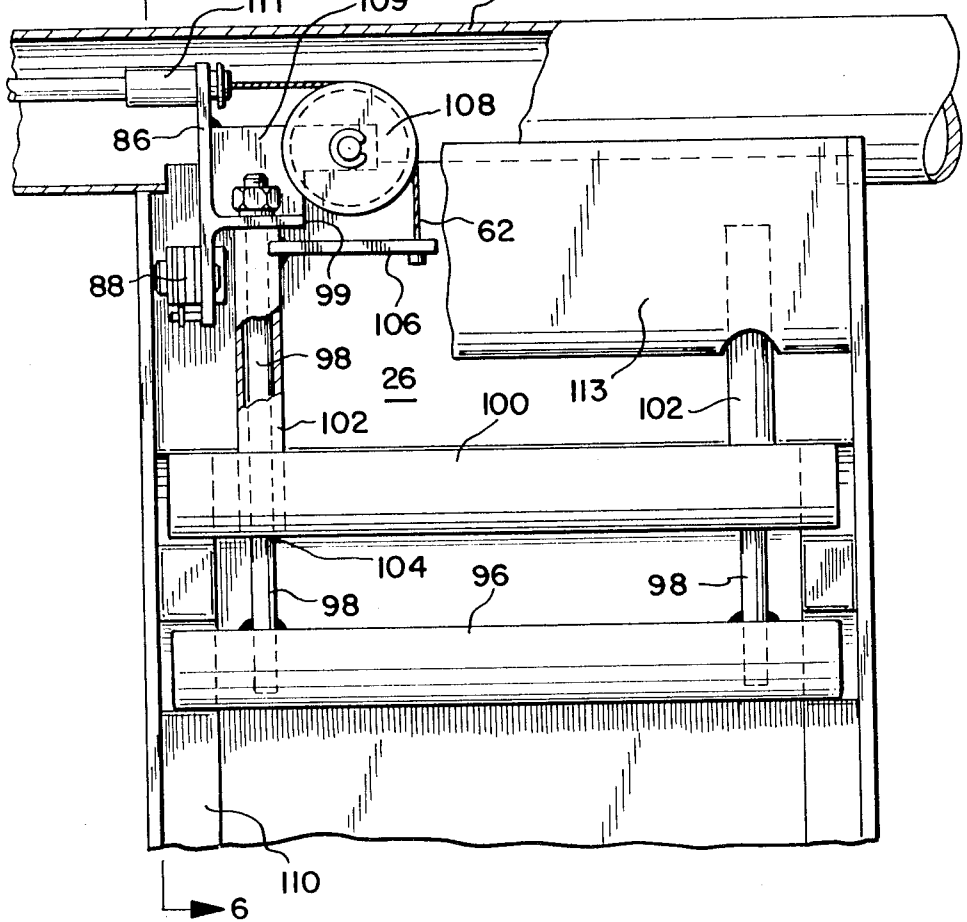
FIG. 5 is an elevational view of the handle mechanism for releasing the latch mechanism, shown partially in section.

The handle mechanism for actuating latch mechanism 46 can be seen by reference to FIGS. 5 and 6. A pair of pivot brackets 86 (only one shown) are each mounted to a mounting tab 88 secured to central portion 26 of side rail assembly 20. A spring 90 is connected between each bracket 86 and side rail assembly 20, so that bracket 86 is biased to a downward, vertical orientation.

A lower handle bar 96, also referred to as a first bar, has a pair of upright posts 98 connected near each end. Each post 98 is threaded at its upper end and is attached by nuts to projection 99 extending inwardly from pivot bracket 86. An upper handlebar 100, also referred to as a second bar, has attached thereto a pair of upright tubes 102. Upper handlebar 100 further includes an opening 104 on its lower side immediately beneath each tube 102. Handlebar 100 and tubes 102 are fitted on posts 98 so that upper handlebar 100 is movable along posts 98 away from and toward lower handlebar 96.

A tab 106 extends inwardly from the upper end of each tube 102. Each tab 106 is in turn connected at its outer end to cable 62. Each cable 62 also passes about a pulley 108 that is rotatably mounted to member 109 connected to pivotal bracket 86. From pulley 108, cable 62 is directed through guide 111 on bracket 86 and along the upper tubing 22 of side rail assembly 20. Cable 62 is then connected at its opposite end to a latch mechanism 46, as has been described previously in connection with FIG. 4.

A plate 113 is secured over brackets 86 and related mechanisms, and serves to both hide and protect the upper portion of the handle mechanism.

As a result of the action of springs 90, handlebars 96 and 100 hang downwardly from tabs 88 and are positioned snugly against central portion 26 of side rail assembly 20. An insert panel 110 (see also FIG. 1) is disposed along central portion 26, and may be formed from a molded plastic material. Insert 110 includes a pair of outer ridges 112 which extend the full height of insert 110. However, a pair of recessed portions 114 and 116 are defined at the upper edge of each ridge 112, and in turn define therebetween a raised projection 118. When the handle assembly is in its normal downward position, lower handlebar 96 is disposed within recessed portions 114, while upper handlebar 100 is disposed within recessed portions 116. Thus, projections 118 serve to prevent any movement of handlebars 96 and 100 toward each other that would tend to release latch mechanism 46.

Figure 7:
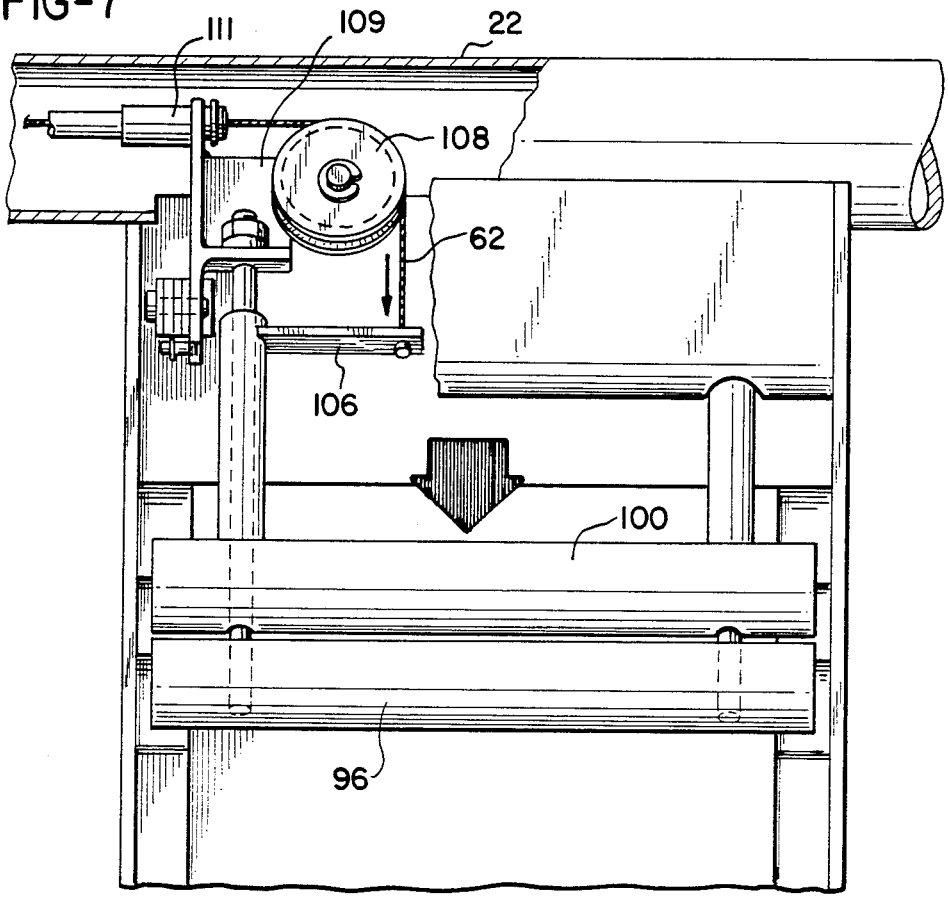
FIG. 7 is a view similar to FIG. 5, showing the handle in its actuated position.

To operate the handle assembly, an operator grips handlebars 96 and 100 with one hand. The assembly is then pivoted forward about brackets 86 until handlebars 96 and 100 have completely cleared ridges 112 of insert 110, as shown in FIG. 6. The operator then moves handlebar 110 toward handlebar 96 by squeezing both bar, shown in FIG. 7. As bar 100 is moved downwardly, cables 62 are drawn toward the handle assembly, thereby actuating each latch mechanism, as has been described, to release the side rail assembly for lowering. Further, the operator can guide the assembly downwardly by continuing the grip the handlebars 96 and 100.

After the side rail assembly has been lowered, releasing of handlebars 96 and 100 permits springs 90 to withdraw them into recesses 114 and 116. Since raising assembly 20 to its original position causes the latch mechanisms to automatically engage the catch bars carried within posts 16, no manipulation of the handle assembly is required for raising assembly 20.

It will be readily recognized that two distinct motions are required in using the handle assembly to disengage the latch mechanisms. Thus, the handle assembly is made more resistant to operation by a child. Further, the handle mechanism is disposed somewhat beneath the uppermost portion of the side rail assembly, and is further located behind (as seen by a child occupying the crib) central portion 26, it is even more difficult for the child to gain access to the handle assembly.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A crib, comprising:

a frame;

a bed surface supported by said frame;

a side rail for enclosing a side of said bed surface;

means attaching said side rail to said frame for raising and lowering movement of said side rail;

latch means for releasably securing said side rail in a raised position;

a handle assembly including;

(a) a first horizontal member pivotally connected to said side rail for pivotal movement away from said side rail, (b) a second horizontal member slidably connected to said first member for movement relative thereto, and disposed in mutual vertical, parallel alignment with said first member for movement toward and away from said first member while maintaining said parallel alignment therebetween, (c) blocking means for preventing relative movement between said first and said second members, said blocking means being connected to said side rail and being additionally for permitting relative movement between said first and said second members upon pivotal movement of said first member away from said blocking means; and an actuator connecting said second member and said latch means, whereby upon pivotal movement of said first member with respect to said side rail, and relative movement between said first and second members, said actuator releases said latch means for lowering of said side rail.

2. A crib as defined in claim 1, wherein said blocking means includes a projection connected to said side rail and normally extending between said first and second members to prevent movement of said second member toward said first member, pivotal movement of said first member causing said first and second members to clear said projection, thereby permitting movement of said second member toward said first member.

3. A crib as defined in claim 1, wherein said first member includes a first bar and said second member includes a second bar, said first and second bars being disposed horizontally in mutual vertical, parallel alignment.

4. A crib as defined in claim 3, wherein said first member further includes a pair of posts connected to said first bar extending in a mutually parallel relationship and upwardly from said first bar, and wherein said second bar is connected to said first bar by being slidably mounted on said posts above said first bar, movement of said second bar toward and away from said first bar being effected by sliding movement along said posts.

5. A crib as defined in claim 4, further comprising spring means for urging said posts toward said side rail, whereby said blocking means is normally disposed between said first and said second bars.

6. A crib as defined in claim 3, wherein said actuator includes a cable connected to said second bar, movement of said second bar toward said first bar applying a pulling force to said cable which is in turn applied to said latch means.

7. A crib as defined in claim 1, wherein said latch means is responsive to a pulling force exerted thereon for releasing said side rail, and wherein said relative movement between said first and second members causes said second member to pull upon said actuator to apply said pulling force to said latch means.

8. A crib as defined in claim 1, wherein said latch means includes:

a trip bar defining a trip axis and having a beveled notch defined into said trip bar;

a latch bar defining a latch axis and having a beveled end surface;

a latch frame connected to said side rail for retaining said trip bar while permitting sliding movement by said trip bar in a linear direction along said trip axis, and for retaining said latch bar while permitting sliding movement along said latch axis with said beveled end surface in contact with said beveled notch, whereby said latch bar follows with linear movement any linear movement of said trip bar;

catch means connected to said frame for engaging said latch bar for securing said side rail;

first spring means for biasing said trip bar into a normal position;

second spring means for biasing said latch bar toward said trip bar; and said actuator being connected to said trip bar, whereby said actuator causes movement of said trip bar such that said end surface of said latch bar, baised by said second spring means, follows said notch to move said latch bar away from said catch means, thereby releasing said side rail.

* * * * *